US009433547B2

(12) United States Patent
Hart et al.

(10) Patent No.: US 9,433,547 B2
(45) Date of Patent: Sep. 6, 2016

(54) CANTILEVERED SUPPORT SYSTEM

(71) Applicant: University Health Network, Toronto (CA)

(72) Inventors: Andrew John Hart, Kleinburg (CA); Geoffrey Roy Fernie, Etobicoke (CA); T. Daniel Smyth, Aurora (CA); Victoria P. Komisar, Calgary (CA); Emily Catherine King, Etobicoke (CA); Adam Matthew Sobchak, Toronto (CA)

(73) Assignee: UNIVERSITY HEALTH NETWORK, Toronto (CA)

( * ) Notice: Subject to any disclaimer, the term of this patent is extended or adjusted under 35 U.S.C. 154(b) by 0 days.

(21) Appl. No.: 14/069,351

(22) Filed: Oct. 31, 2013

(65) Prior Publication Data

US 2015/0115119 A1 Apr. 30, 2015

(51) Int. Cl.

| | |
|---|---|
| ***A61G 5/14*** | (2006.01) |
| ***A61G 7/10*** | (2006.01) |
| ***A47K 17/02*** | (2006.01) |

(52) U.S. Cl.

CPC ..... *A61G 7/1038* (2013.01); *A47K 17/022* (2013.01); *A61G 5/14* (2013.01); *A47K 2201/02* (2013.01)

(58) Field of Classification Search

CPC ..... A61G 5/14; A61G 7/053; A61G 7/1038; A61G 7/1044; A47G 3/003; A47G 17/022; A47G 2201/02; E04G 5/046; A61H 2201/0126

USPC ..... 4/576.1, 577.1; 5/662; 248/251, 354.1, 248/274.1, 295.11, 298.1

See application file for complete search history.

(56) References Cited

U.S. PATENT DOCUMENTS

| | | | | |
|---|---|---|---|---|
| 3,568,220 | A * | 3/1971 | Dees | A47K 3/003 4/576.1 |
| 3,848,480 | A | 11/1974 | Oseroff et al. | |
| 4,498,204 | A * | 2/1985 | Warner | A47K 3/003 4/254 |
| 5,586,352 | A * | 12/1996 | O'Brien | A61G 7/053 248/200.1 |
| 6,012,182 | A * | 1/2000 | Allen | A61G 5/14 5/503.1 |
| 6,138,301 | A * | 10/2000 | Battiston | A61G 7/053 5/659 |
| 6,401,280 | B1 * | 6/2002 | Baker | A47C 21/08 5/426 |
| 6,854,163 | B1 | 2/2005 | Ruana | |
| 6,922,857 | B2 * | 8/2005 | Palma | A47K 3/12 4/573.1 |
| 7,040,642 | B2 | 5/2006 | Lowry | |
| 7,931,385 | B1 | 4/2011 | Smith | |
| 7,934,701 | B2 | 5/2011 | Kay | |
| 2003/0057020 | A1 * | 3/2003 | Carder | E04G 1/30 182/118 |
| 2003/0159250 | A1 | 8/2003 | Ruana | |

(Continued)

FOREIGN PATENT DOCUMENTS

| | | | |
|---|---|---|---|
| FR | 2536830 | * | 6/1984 |

OTHER PUBLICATIONS

Ebay Oury Grips Mountain Bike Grips Glow-in-the-dark, retrieved from the Internet on Jan. 20, 2012.

(Continued)

*Primary Examiner* — Ryan Kwiecinski

(74) *Attorney, Agent, or Firm* — Philip C. Mendes da Costa; Bereskin & Parr LLP/S.E.N.C.R.L., s.r.l.

(57) ABSTRACT

A cantilevered support system is provided. The cantilevered support system comprises a vertical support pole and longitudinally extending upper and lower support arm assemblies that are securable to a wall.

9 Claims, 12 Drawing Sheets

(56) References Cited

U.S. PATENT DOCUMENTS

2005/0102868 A1 5/2005 Ruana
2006/0053547 A1* 3/2006 Farrow ..... A47K 17/024 4/576.1
2006/0289046 A1* 12/2006 Cato, III ..... A61G 5/14 135/73
2007/0086852 A1* 4/2007 Goad ..... A47K 17/022 403/292
2008/0098510 A1* 5/2008 O'Brien ..... A47K 17/024 4/576.1
2008/0222790 A1* 9/2008 Grant ..... A47K 3/003 4/576.1
2010/0001246 A1 1/2010 Kay
2010/0037971 A1 2/2010 Scherer
2011/0214946 A1* 9/2011 Yeh ..... E06C 7/44 182/201
2011/0239365 A1* 10/2011 Grant ..... A47K 3/003 4/576.1
2012/0240327 A1* 9/2012 Stimpson ..... A47K 3/003 4/605
2012/0246813 A1* 10/2012 Manning ..... A47K 17/026 4/254
2013/0112832 A1* 5/2013 Hilton ..... A47C 21/028 248/354.1
2014/0134358 A1* 5/2014 Hart ..... A47K 17/022 428/34.1
2014/0134359 A1* 5/2014 Hart ..... A47K 17/022 428/34.1

OTHER PUBLICATIONS

Stairglow Emergency Exit Stairwell Products, retrieved from the Internet on Jan. 20, 2012.
Green Glow Stick Handle, retrieved from the Internet on Jan. 20, 2012.
Oury Soft rubber Mountain Bike Grips (17 colors), retrieved from the Internet on Jan. 24, 2012.
GripLink: About us, retrieved from the Internet on Jan. 19, 2012.
GripLink: Common Questions, retrieved from the Internet on Jan. 19, 2012.
GripLink: Workplace Info, retrieved from the Internet on Jan. 19, 2012.

* cited by examiner

CANTILEVERED SUPPORT SYSTEM

FIELD OF THE INVENTION

This specification relates to the field of support systems for providing assistance to, e.g. the elderly and the infirm.

BACKGROUND

Sick, injured, disabled, and elderly people can have difficulty with mobility. In some cases, it can be difficult for these and other people to sit up and/or stand from a bed, couch or seat for example.

It is known to provide support poles, grab bars, handrails and the like for people who are elderly of otherwise require support to stand or walk. In order to assist users, it is known to provide a grip to such structures. See for example, U.S. Pat. No. 6,854,163 which discloses a releasably attachable grip. Different types of covers are also known.

An important feature of support systems which are utilized by the elderly and infirm is the ability of the support system to remain in a static position during use. For example, if a support pole were to move when pressure is applied by a user, then the user could stumble and injure themselves.

SUMMARY

In accordance with one aspect of this application, a cantilevered support system is provided. Accordingly, a support pole may be provided that is secured at two or more locations to a wall. In some environments, such as a hospital, the ceiling is not a fixed but may be a drop ceiling comprising a plurality of ceiling tiles. Accordingly a support pole cannot easily be secured between the floor and the ceiling. The support pole may engage the floor. However, the upper end may not be secured to, and may be spaced from, the ceiling. Accordingly the upper end of the support pole and the lower end of the support pole may be secured to a wall and some vertical load may be transmitted to the floor, e.g., by a foot member.

In accordance with this aspect, there is provided a cantilevered support system comprising:

(a) a vertical support pole having an upper end and a lower end;

(b) a foot member provided on the lower end of the vertical support pole;

(c) a longitudinally extending upper support arm assembly having an inner end securable to a wall and an outer end securable to the vertical support pole; and, (d) a longitudinally extending lower support arm assembly having an inner end securable to a wall and an outer end securable to the vertical support pole.

In some embodiments, the foot member may comprise a height adjustment member.

In some embodiments, the outer end of each support arm assembly may comprise an openable clamping member and the vertical support pole may be releasably securable to the clamping member.

In some embodiments, each support arm assembly may be longitudinally adjustable whereby the opeanable clamping member may be positionable at varying distances from the wall.

In some embodiments, the cantilevered support system may further comprise a wall mount system and the inner end of each support arm assembly may be permanently secured to the wall mount system.

In some embodiments, the cantilevered support system may further comprise a wall mount system comprising an upper wall mount member and a lower wall mount member, the inner end of the upper support arm assembly may be supported by the upper wall mount member and the inner end of the lower support arm assembly may be supported by the lower wall mount member.

In some embodiments, the cantilevered support system may further comprise a wall mount system and the inner end of each support arm assembly may be supported by the wall mount system and horizontally extending stabilizers may extend between the wall mount system and the inner end of each support arm assembly.

In some embodiments, the cantilevered support system may further comprise a wall mount system which comprises an elongate member and the each support arm assembly may be positionable at alternate positions along the elongate member.

In some embodiments, the wall mount system may comprise an upper elongate member and a lower elongate member, the upper support arm assembly may be slidably mounted along the upper elongate member and the lower support arm assembly may be slidably mounted along the lower elongate member.

In accordance with this aspect, there is also provided a method of providing support for a person comprising:

(a) securing an inner end of an upper support arm assembly to a wall;

(b) securing an inner end of a lower support arm assembly to the wall;

(c) securing a vertical support pole having an upper end and a lower end to the upper and lower support arms; and, (d) positioning the lower end of the vertical support member against a floor.

In some embodiments, the lower end of the vertical support member may comprise a height adjustable foot member and the method may further comprise adjusting the foot member such that the lower end of the vertical support member engages the floor.

In some embodiments, the vertical support pole may be positionable at varying distances from the wall and the method may further comprise selecting the position of the vertical support pole from the wall.

In some embodiments, each support arm may be securable to an elongate wall mount member at alternate positions along the elongate wall mount member and the method may further comprise positioning each support arm at a desired position along the elongate wall mount members.

In some embodiments, each support arm may be slidably mounted to the elongate wall mount members and the method may further comprise sliding the support arms at the desired position along the elongate wall mount members.

In some embodiments, the method may further comprise securing the elongate wall mount members to the wall at a location at the head of a bed or behind a toilet or a seating member.

In some embodiments, the inner end of each support arm assembly may be secured to a wall mount system comprising at least one wall mount member and a stabilizer is provided between the each support arm assembly and the at least one wall mount member and the method may further comprise positioning the wall mount system such the stabilizers extend generally horizontally.

In accordance with another aspect, a cantilevered support system may be configured to inhibit lateral (horizontal) movement of the arm members that support the vertical support pole.

In accordance with this aspect, there is provided a cantilevered support system comprising (a) a vertical support pole having an upper end and a lower end;

(b) a wall mount system comprising an upper wall mount member and a lower wall mount member;

(c) an upper support arm assembly extending longitudinally from the upper wall mount member and having an outer end securable to the vertical support pole and a horizontally extending stabilizer extending between the upper wall mount member and the upper support arm assembly; and, (d) a lower support arm assembly extending longitudinally from the lower wall mount member and having and an outer end securable to the vertical support pole and a horizontally extending stabilizer extending between the lower wall mount member and the lower support arm assembly.

In some embodiments, the cantilevered support system further comprises a height adjustable foot member provided on the lower end of the vertical support pole.

In some embodiments, the outer end of each support arm assembly may comprise an openable clamping member and the vertical support pole may be releasably securable to the clamping member.

In some embodiments, each support arm assembly may be longitudinally adjustable whereby the opeanable clamping member may be positionable at varying distances from the wall.

In some embodiments, an inner end of each support arm assembly may be permanently secured to the respective wall mount member.

In some embodiments, the wall mount system may comprise an upper elongate member and a lower elongate member, the upper wall mount member may be slidably mounted along the upper elongate member and lower wall mount member may be slidably mounted along the lower elongate member.

In accordance with this aspect, there is also provided a method of providing support for a person comprising:

(a) securing an inner end of an upper support arm assembly to a wall;

(b) securing an inner end of a lower support arm assembly to the wall;

(c) securing a vertical support pole having an upper end and a lower end to the upper and lower support arms; and, (d) laterally stabilizing at least one of the upper and lower support arm assemblies.

In some embodiments, the inner end of each support arm assembly may be secured to a wall mount system comprising at least one wall mount member and a stabilizer may be provided between each support arm assembly and the at least one wall mount member and the method may further comprise positioning the wall mount system such the stabilizers extend generally horizontally.

In some embodiments, the lower end of the vertical support member may comprise a height adjustable foot member and the method may further comprise adjusting the foot member such that the lower end of the vertical support member engages the floor.

In some embodiments, the vertical support pole may be positionable at varying distances from the wall and the method may further comprise selecting the position of the vertical support pole from the wall.

In some embodiments, each support arm may be securable to an elongate wall mount member at alternate positions along the elongate wall mount member and the method may further comprise positioning each support arm at a desired position along the elongate wall mount members.

In some embodiments, each support arm may be slidably mounted to the elongate wall mount members and the method may further comprise sliding the support arms at the desired position along the elongate wall mount members.

In some embodiments, the method may further comprise securing the elongate wall mount members to the wall at a location at the head of a bed or behind a toilet or a seating member.

In accordance with another aspect, a cantilevered support system may be positionable at alternate positions along a wall without removing a mount from a wall but instead by moving the arm members to alternate mounts or sliding the arm members along a wall mount member.

In accordance with this aspect, there is provided a cantilevered support system comprising:

(a) a vertical support pole having an upper end and a lower end;

(b) a wall mount system which comprises at least one elongate member;

(c) an upper support arm assembly extending longitudinally from the wall mount system and an outer end securable to the vertical support pole;

(d) a lower support arm assembly extending longitudinally from the wall mount system and an outer end securable to the vertical support pole, wherein each support arm assembly is positionable at alternate positions along the at least one elongate member.

In some embodiments, the at least one elongate member may comprise an upper elongate member and a lower elongate member, the upper support arm assembly may be slidably mounted along the upper elongate member and the lower support arm assembly may be slidably mounted along the lower elongate member.

In some embodiments, the cantilevered support system may further comprise a height adjustable foot member provided on the lower end of the vertical support pole.

In some embodiments, the outer end of each support arm assembly may comprise an openable clamping member and the vertical support pole may be releasably securable to the clamping member.

In some embodiments, each support arm assembly may be longitudinally adjustable whereby the opeanable clamping member may be positionable at varying distances from the wall.

In some embodiments, each support arm assembly may be permanently secured to a wall mount member which may be slidably mountable to the at least one elongate member.

In some embodiments, the at least one elongate member may comprise an upper elongate member and a lower elongate member, the wall mount member may comprise an upper wall mount member and a lower wall mount member, the upper wall mount member may be slidably mounted along the upper elongate member and lower wall mount member may be slidably mounted along the lower elongate member.

In some embodiments, each support arm assembly may be provided with a wall mount member and a horizontally extending stabilizer may extend between the wall mount member and an inner end of each support arm assembly.

In accordance with this aspect, there is also provided a method of providing support for a person comprising:

(a) providing an upper support arm assembly;

(b) providing a lower support arm assembly;

(c) providing an elongate wall mount member;

(d) positioning each support arm at a desired position along the elongate wall mount members; and, € securing a vertical support pole having an upper end and a lower end to the upper and lower support arms.

In some embodiments, each support arm may be securable to an elongate wall mount member at alternate positions along the elongate wall mount member and the method may further comprise positioning each support arm at a desired position along the elongate wall mount members.

In some embodiments, each support arm may be slidably mounted to the elongate wall mount members and the method may further comprise sliding the support arms at the desired position along the elongate wall mount members.

In some embodiments, the method may further comprise securing the elongate wall mount members to the wall at a location at the head of a bed.

In some embodiments, the method may further comprise laterally stabilizing at least one of the upper and lower support arm assemblies.

In some embodiments, an inner end of each support arm assembly may be provided on a wall mount member and a stabilizer may be provided between each support arm assembly and the wall mount member and the method may further comprise positioning the wall mount member on the elongate member such the stabilizers extend generally horizontally.

In some embodiments, the lower end of the vertical support member may comprise a height adjustable foot member and the method may further comprise adjusting the foot member such that the lower end of the vertical support member engages the floor.

In some embodiments, the vertical support pole may be positionable at varying distances from the wall and the method may further comprise selecting the position of the vertical support pole from the wall.

BRIEF DESCRIPTION OF THE DRAWINGS

These and other advantages will be understood in conjunction with the following description of the preferred embodiments in which.

DESCRIPTION OF THE PREFERRED EMBODIMENT

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

Figure 1:
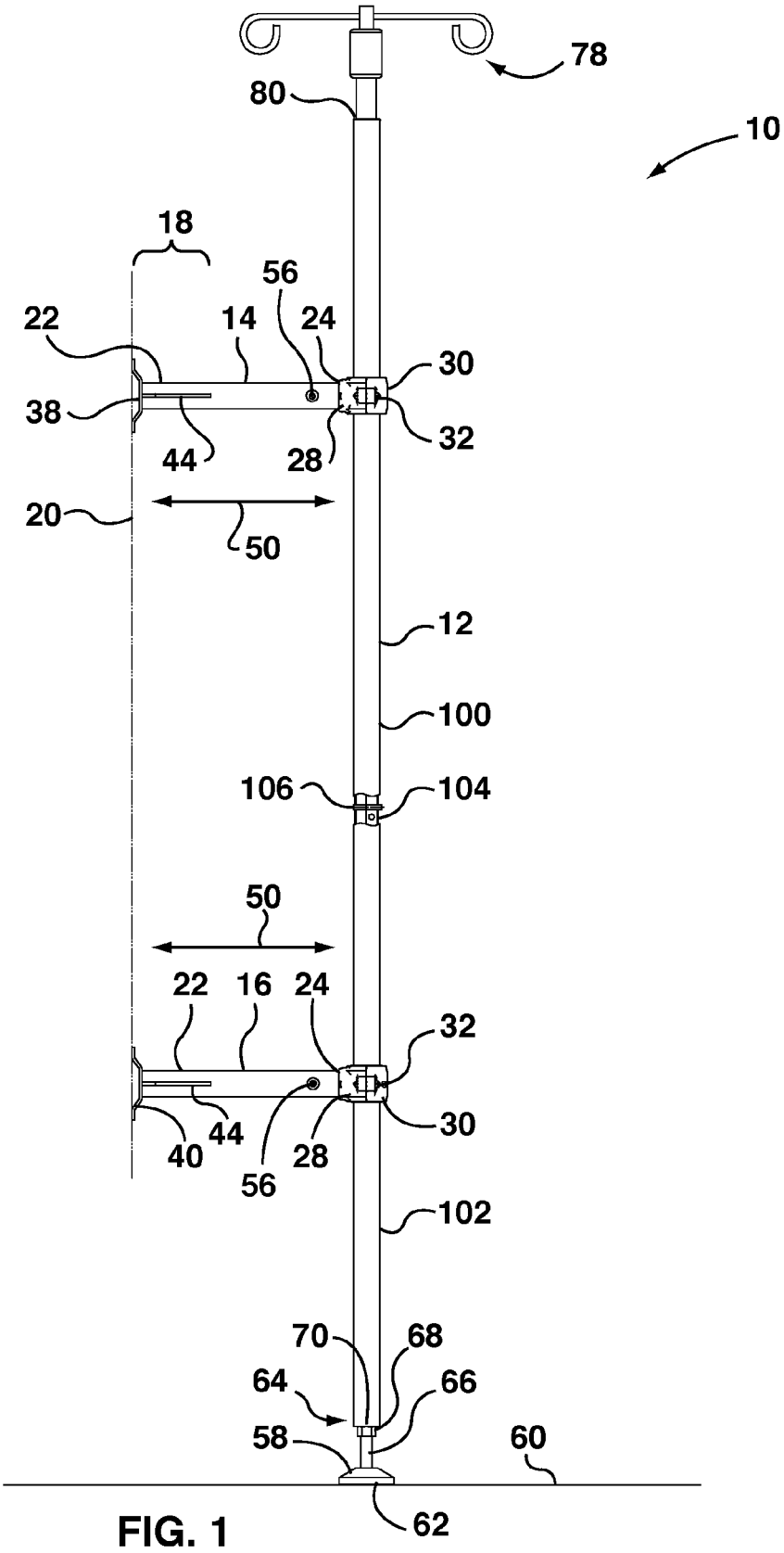
FIG. 1 is a side elevation view of a cantilevered support system according to a first embodiment.
Figure 2:
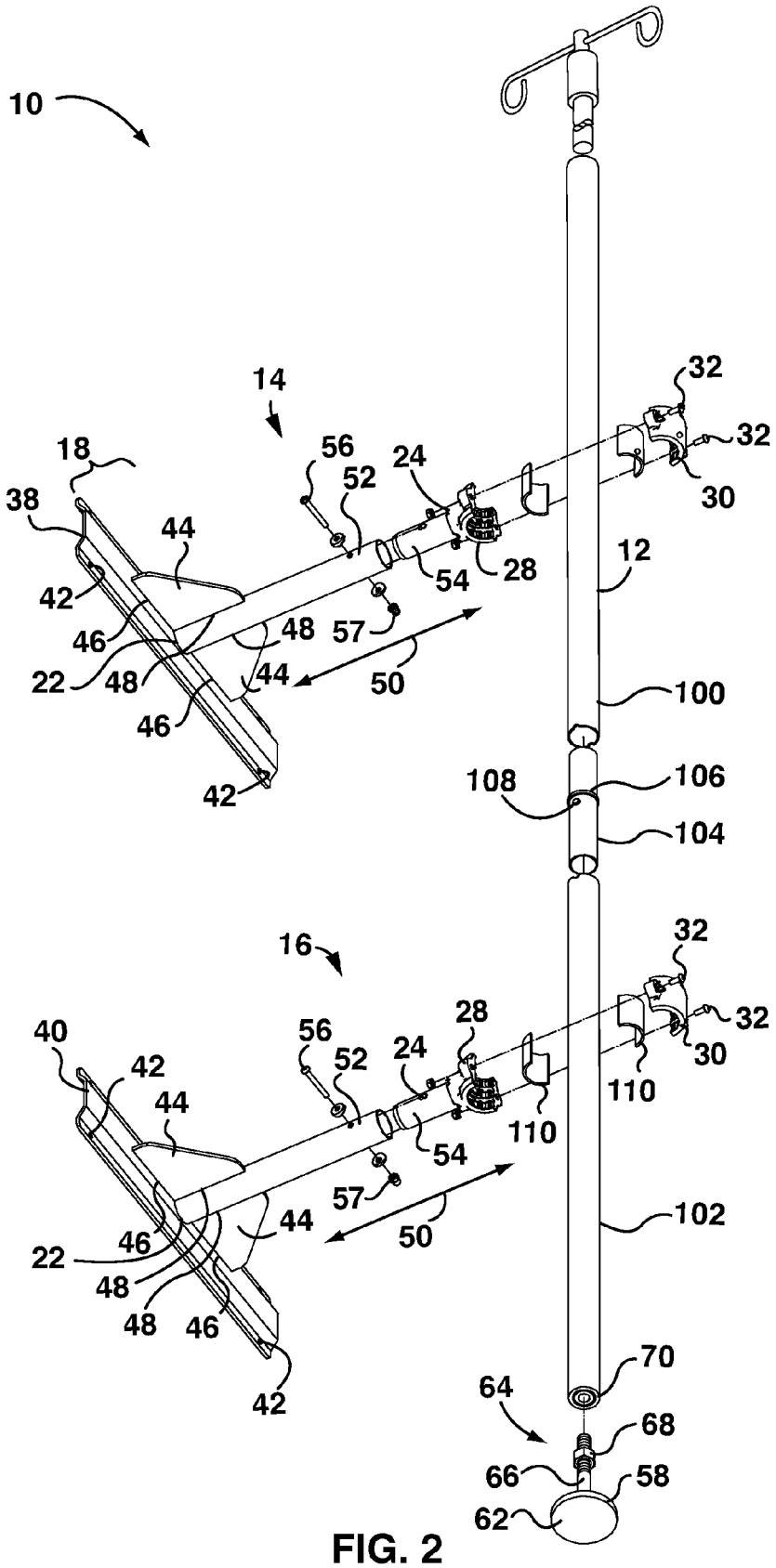
FIG. 2 is a perspective exploded view of the cantilevered support system of FIG. 1.

As exemplified in FIGS. 1 and 2, cantilevered support system 10 includes a vertical support pole 12 and upper and lower longitudinally extending support arm assemblies 14 and 16. An inner end of each upper and lower longitudinally extending support arm assembly 14, 16 is secured to wall 20 and the outer end 24 of each upper and lower longitudinally extending support arm assembly 14, 16 is secured to vertical support pole 12. Accordingly, each upper and lower longitudinally extending support arm assembly 14, 16 is used to cantilever vertical support pole 12 from wall 20.

As also exemplified, an optional wall mount system 18 may be provided. Wall mount system 18 is adapted to secure inner end of upper and lower longitudinally extending support arm assemblies 14, 16 to wall 20. As also exemplified, an option foot member 58 may be provided. Foot member may be secured to the bottom of vertical support pole 12 and provides an interface between the floor 60 and vertical support pole 12. Preferably, foot member 58 is height adjustable.

In the example shown, vertical support pole 12 is a cylindrical member which extends substantially vertically. In some examples, vertical support pole 12 has a circular cross-section and a diameter which can be comfortably gripped by a user's hands. In some examples, vertical support pole 12 has a diameter of between 1 inch and 4 inches. In some examples, vertical support pole 12 has a diameter of approximately 2 inches.

In alternative embodiments, vertical support pole 12 may have a cross-section that is not circular. In some examples, vertical support pole 12 has a cross-section that is substantially triangular, square, hexagonal, irregularly polygonal or curved. In some examples, the cross-section of vertical support pole 12 may vary along its length.

It will be appreciated that vertical support pole may comprise one or more pole members. For example, as shown in FIG. 2, vertical pole member 12 comprises an upper pole member 100, a lower pole member 102 and a pole member connector 104. Pole member connector 104 is receivable in the lower end of upper pole member 100 and the upper end of lower pole member 102. Pole member connector may be secured in position by any means known in the art. For example, pole member connector 104 may be provided with a flange 106. Accordingly, when assembled, the lower surface of flange 106 may seat on the upper end of lower pole member 102 and the lower end of upper pole member 100 may seat on the upper surface of flange 106. Alternately, or in addition, one or more set screws or the like may be used to secure one or both of upper and lower pole members 100, 102 to pole member connector 104. For example, pole member connector 104 may have one or more openings 108 for receiving a set screw. Other means include welding, adhesive and using mating threads.

In another embodiment, the upper and lower pole members 100, 102 may be telescopically connected, e.g., upper pole member 100 may be receivable in lower pole member 102 and secured thereby at varying insertion positions. An advantage of this design is that the size of the packaging may be shorter and facility shipping.

It will also be appreciated that, since vertical support pole 12 is secured to wall 20, it need not extend from floor to ceiling but may be extend upwardly from the floor a sufficient distance to provide a hand support to a person who is standing. Further, as exemplified in FIG. 3, it need not extend to the floor. Accordingly, vertical support pole 12 may only have a sufficient vertical extend to provide a hand support for a person while standing and/or sitting.

Longitudinally extending support arm assemblies 14 and 16 have an inner end 22 and an outer end 24. One or more longitudinally extending support arm assembly 14, 16 is provided to enable vertical support pole 12 to be secured to wall 20 and, optionally, to provide a cantilever support for vertical support pole 12. As exemplified, two longitudinally extending support arm assemblies 14, 16 are provided. It will be appreciated that more than two longitudinally extending support arm assemblies may be provided. Each longitudinally extending support arm assembly may be the same or different. Preferably, the longitudinally extending support arm assemblies are positioned one above the other such that the longitudinally extending support arm assemblies are parallel when in use.

Outer end 24 is adapted to be secured to vertical support pole 12. For example, outer end 24 may be releasably securable, permanently securable or integral with vertical support pole 12.

As exemplified in FIGS. 1 and 2, each outer end 24 includes an openable clamping member 26 that is releasably securable to vertical support pole 12. Clamping member 26 may comprise a plurality of parts and, as exemplified, clamping member 26 includes an inner casing 28 and an outer casing 30 that are positioned surrounding a circumference of vertical support pole 12. As shown, fasteners 32 (e.g., a screw and mating bolt) extend through openings in clamping members 28 and 30 and, as they are tightened, they urge inner and outer casings 28 and 30 to bear on vertical support pole 12. In some embodiments, fasteners 32 may be selectively tightened or loosened to prevent or permit movement of vertical support pole 12 relative to clamping member 26 (e.g. to enable vertical support pole 12 to be moved downwardly so as to rest against floor 60).

Clamping member 26 is one example of a device for securing vertical support pole 12 to a longitudinally extending support arm assembly 14 or 16. In alternative embodiments, clamping member 26 may alternately, or in addition, comprise one or more of magnets, hooks, screws, bolts, nails, or rivets, a fitting into which an upper end of lower pole member 102 may be received and/or a fitting into which a lower end of upper pole member 100 may be received.

As shown in FIG. 2, a grip member 110 may be provided between vertical support pole 12 and casing 28, 30. Grip member may be a resilient member that enhances the frictional contact between the inner surface of casings 28, 30 and vertical support pole 12. For example, if vertical support pole 12 does not contact floor 60, then the contact between vertical support pole 12 and clamping member 26 is preferably sufficient for vertical support pole 12 to non-slidably received in clamping member 26 when a load is placed on vertical support pole 12 (e.g., a person uses vertical support pole 12 to assist them moving to a standing position).

In some embodiments, one or both of longitudinally extending support assemblies 14 and 16 may be integral with vertical support pole 12 by, e.g. integral forming or welding. As exemplified in FIG. 3, in cantilevered support system 34, longitudinally extending support arm assemblies 14 and 16 are integrally formed with vertical support pole 12. In the example shown, cantilevered support system 34 comprises a single hollow tube that has been bent at location 36 to form longitudinally extending support arm assemblies 14 and 16 and vertical support pole 12.

In another embodiment, each of longitudinally extending support arm assemblies 14 and 16 and vertical support pole 12 may be separately formed and connected with a 90° elbow at location 36. The parts may be connected together by, e.g., an adhesive or welding, or by a mechanical fastener.

Inner end 22 is adapted to be secured to wall 20. For example, inner end may be provided with an integrally provided wall mount 18 or inner end 22 may be releasable securable to a wall mount 18. Preferably, a separate wall mount 18 may be provided for each longitudinally extending support arm assembly 14 and 16. However, a single wall mount 18 may be used to secure or releasably secure each longitudinally extending support arm assembly 14 and 16 to wall 20. Wall mount 18 may be permanently secured to wall 20 or may be releasably secured to wall 20.

As exemplified in FIGS. 1 and 2, wall mount system 18 includes upper and lower wall mount members 38 and 40. Accordingly, inner end 22 of longitudinally extending support arm assembly 14 is coupled to upper wall mount member 38 and inner end 22 of longitudinally extending support arm assembly 16 is coupled to lower wall mount member 40.

Upper and lower wall mount members 38 and 40 may be of any design that is adapted to be secured to wall 20. Preferably, upper and lower wall mount members 38 and 40 have a longitudinally extending member (e.g. plate or horizontally extending bracket 41) and may be secured to wall 20 by a plurality of fasteners 42 (e.g. screws, nails, or bolts) that extend through openings 43 in plate 41. Plate 41 may be of any design and, when mounted to a wall, preferably extends generally horizontally and may be long enough to overlie two wall studs.

Each longitudinally extending support arm assembly 14, 16 may be secured to a wall mount members by any means known in the art. For example, a longitudinally extending support arm assembly 14, 16 may be secured to a wall mount member by one or more of an adhesive, welding, screws, bolts, nails, magnets, hooks, cables, and rivets. Alternately, a wall mount member 38, 40 may be integrally formed with a longitudinally extending support arm assembly 14, 16.

As with vertical support pole 12, one of both of longitudinally extending support arm assemblies 14, 16 may be a single longitudinally extending member or it may be a plurality of members. As shown in FIG. 2, longitudinally extending support arm assembly 14, 16 comprises a first or inner arm member 52 and a second or outer arm member 54. In such a construction, inner arm members 52 may be provided as part of wall mount members 38, 40 (if they are integrally formed) or may be secured to wall mount members 38, 40. For example, inner arm member 52 may be provided with a bolt that extends from the inner end of inner arm member 52 and extends through an opening in plate 41 and is secured thereto by a bolt.

As with vertical support pole 12, inner and outer arm members 52, 54 may be secured together by any means known in the art. As exemplified, a fastener 56 extends through first arm member 52 and second arm member 54 and is secured in position by a nut 57. Washers may be provided between fastener 56 and arm member 52 and between nut 57 and arm member 52. Other optional securing means include welding, adhesive, other mechanical fasteners such as set screws, using mating threads and the like.

Optionally, each support arm assembly 14, 16 may be longitudinally adjustable whereby the opeanable clamping member 26 is positionable at varying distances from the wall 20, e.g., in the direction of arrow 50. For example, first arm member 52 and second arm member 54 may be telescopically connected such that, one member (e.g., second arm member 54) may be insertable into the other member (e.g., first arm member 52) varying distances so as to provide a longitudinally extending support arm assembly 14 or 16 having a variable longitudinal length. Accordingly, clamping member 26 may be positioned at variable distances from wall 20 and therefore vertical support pole 12 may be positionable at a varying distances from wall 20 (e.g. to align with a bed, couch or chair in the room).

In alternative embodiments, longitudinally extending support arm assemblies 14 and 16 include a different suitable structure which permits longitudinal adjustment. In some examples (not shown), one or both of longitudinally extending support arm assemblies 14 and 16 includes a plurality of removable arm members which can be selectively connected in series or removed to provide a plurality of selectable lengths for the longitudinally extending support arm assembly 14, 16. Alternately, or in addition, arm members of varying length may be provided as part of a kit and only some may be used to form a longitudinally extending support arm assembly 14, 16.

Figure 3:
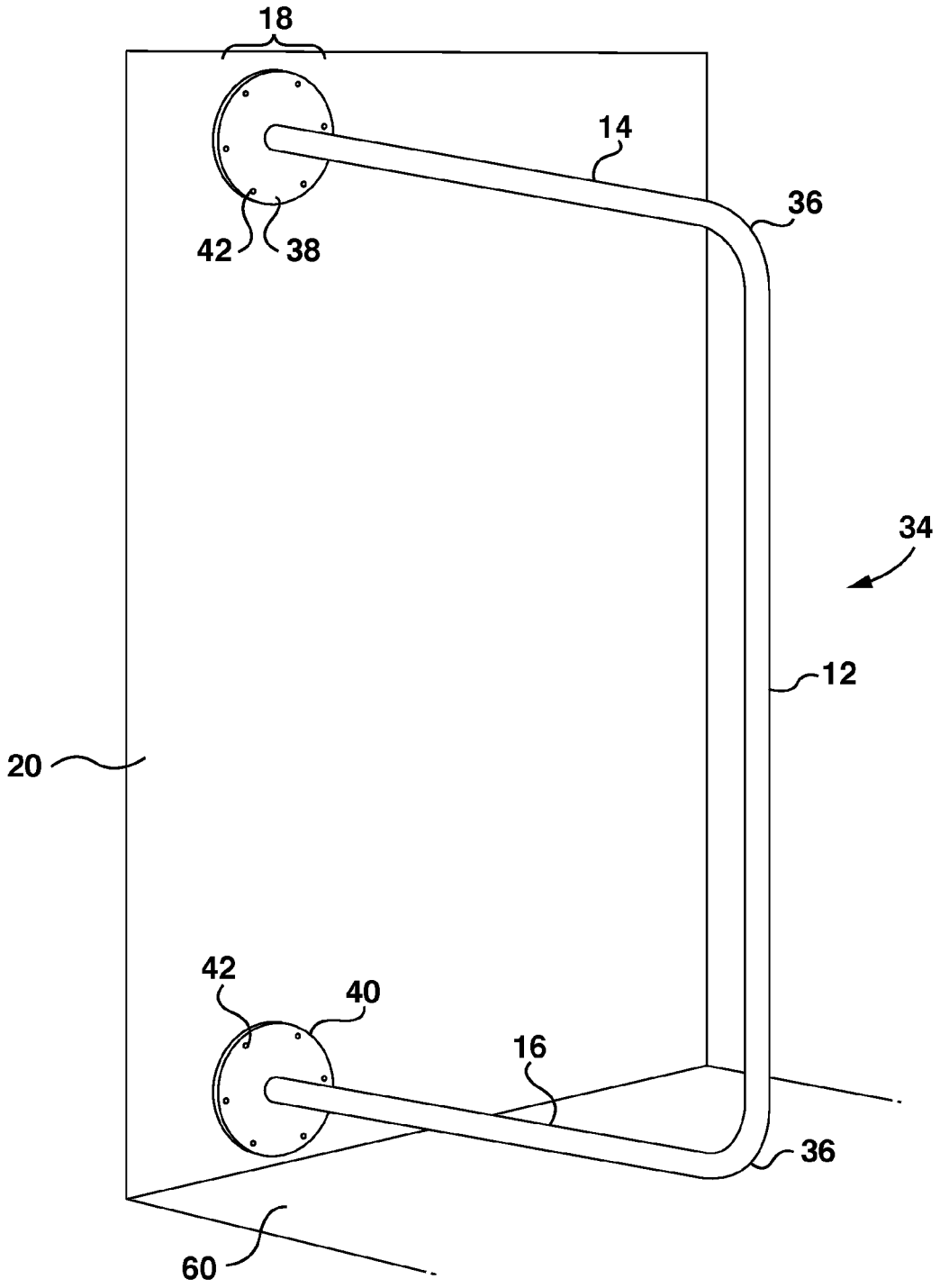
FIG. 3 is a perspective view of a cantilevered support system according to a further embodiment.
Figure 4:
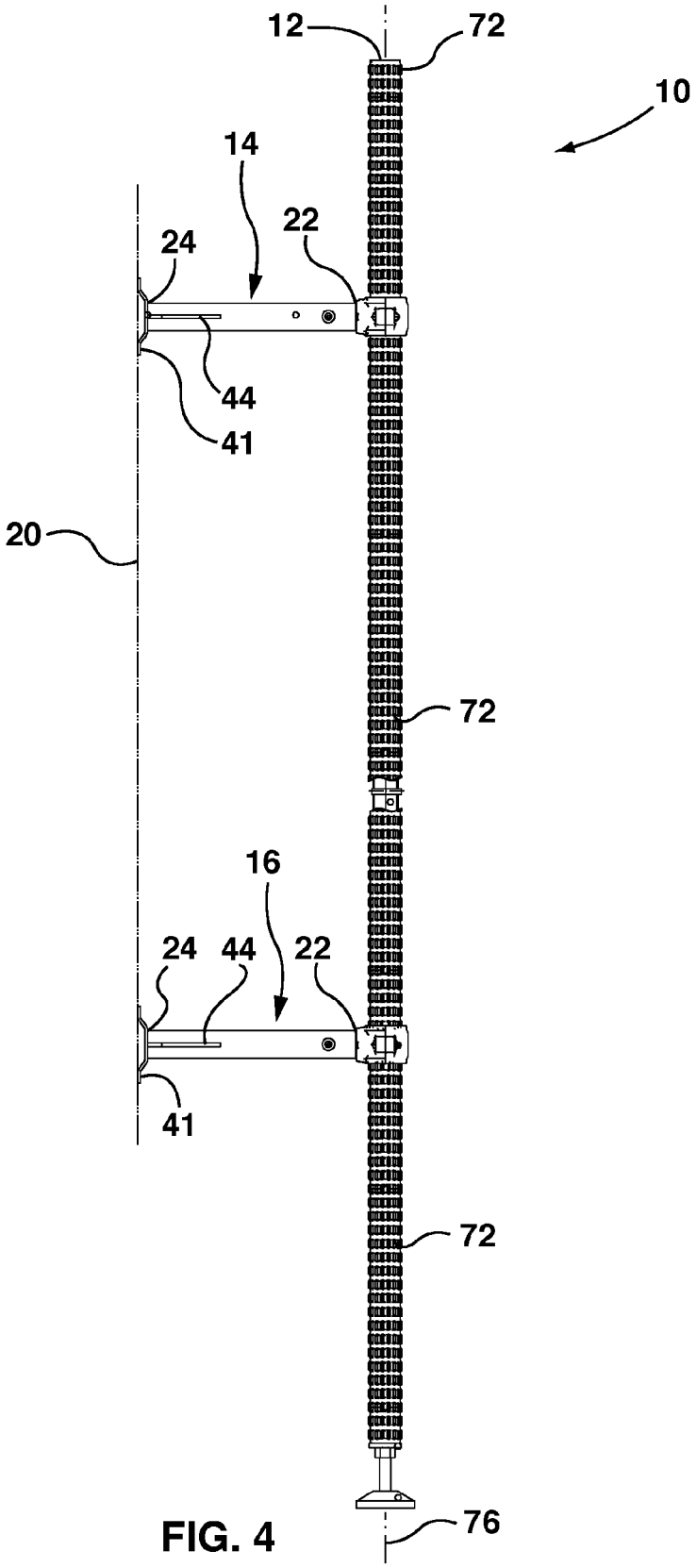
FIG. 4 is a side elevation view of a cantilevered support system with gripping members according to a further embodiment.

In some embodiments, one or both of longitudinally extending support arm assemblies 14 and 16 may not be longitudinally adjustable. FIG. 3 shows an example of a cantilevered support system 34 in which both of longitudinally extending support arm assemblies 14 and 16 is of a fixed length.

Optionally, longitudinally extending support arm assemblies 14, 16 are horizontally stabilized. As exemplified in FIG. 2, cantilevered support system 10 includes a plurality of horizontally extending stabilizers 44. Each horizontally extending stabilizer 44 is shown coupled to a wall mount member 38 or 40, and the respective longitudinally extending support arm assembly 14 or 16. As shown, horizontally extending stabilizer 44 extends between plate 41 and inner arm portion 52. Accordingly, horizontally extending stabilizer 44 provides lateral stability against horizontal force components, which may be applied, for example, by a user grasping vertical support pole 12 to help them stand from an adjacent bed, seat or couch. Preferably, a stabilizer 44 is provided on each opposed side of inner arm member 52.

Each horizontally extending stabilizer 44 may be coupled to a wall mount member 38, 40, and a longitudinally extending support arm assembly 14, 16 by any suitable means, such as by using one or more of adhesive, welding, screws, bolts, nails, magnets, hooks, cables, and rivets. In some embodiments, horizontally extending stabilizer 44 may be integrally formed with wall mount member 38, 40, and/or a longitudinally extending support arm assembly 14, 16. For example, left and right stabilizers 44 may be secured to plate 41 by a mechanical fastener, such as a screw and nut, and inner arm member 52 may be received in a space between stabilizers 44. Inner arm member 52 may have a longitudinally extending groove in which stabilizer 44 is received as inner arm member is slid into the space between stabilizers 44. Alternately, stabilizers 44 may be affixed to inner arm member 52 (e.g., by welding) and abut against plate 41 when inner arm member 52 is secured to plate 41. Optionally, left and right stabilizers 44 may also be secured to plate 41.

Horizontally extending stabilizers 44 may have any suitable shape. In the example shown, horizontally extending stabilizers 44 are substantially right-angle triangular panels including two perpendicular sides 46 and 48 each of which may be connected to or abut, one of a wall mount member 38, 40 and a longitudinally extending support arm assembly 14, 16 (see FIG. 2). It will be appreciated that stabilizers 44 may be of any design that inhibits lateral (horizontal) movement of longitudinally extending support arm assembly 14, 16 with respect to plate 41. Accordingly, it may be formed from an open mesh or it may comprise one or more rods or beams extending at a diagonal between plate 41 and longitudinally extending support arm assembly 14, 16. For example, stabilizer 44 may be a cylindrical rod fastened at one end to a longitudinally extending support arm assembly 14, 16 and fastened at the other end to a wall mount member 38, 40 so as to extend generally horizontally at an angle to both (e.g. between a 20 and 70°).

While it is preferred that a horizontally extending stabilizer 44 on each opposite horizontal side of longitudinally extending support arm assemblies 14, 16, it will be appreciated that a stabilizer 44 may be provided on only side of longitudinally extending support arm assembly 14, 16. In alternative embodiments, as exemplified in FIG. 3 a cantilevered support system may not include horizontally extending stabilizers.

As exemplified in FIGS. 1 and 2, cantilevered support system 10 may include a foot member 58 provided on the lower end 70 of vertical support pole 12. As shown, foot member 58 has a lower surface 62 that is adapted to engage the floor 60. Accordingly, when foot member 58 engages floor 60, a vertical load that is applied to vertical support pole 12 may be transferred to floor 60, thereby improving the rigidity, stability and vertical weight bearing capacity of cantilevered support system 10.

In the example shown, foot member 58 has a circular and planar lower surface 62 that engages floor 60. In alternative embodiments, lower surface 62 has any suitable shape, such as triangular, rectangular or other regular or irregular polygonal shape for example. In some embodiments, lower surface 62 has other than a planar lower surface 62. In some examples, lower surface 62 has one or more of treads, ridges, hills, or valleys). This may permit lower surface 62 to better engage ground surfaces which have uneven height profiles.

Preferably, foot member 58 includes a height adjustment member 64. As exemplified, height adjustment member 64 includes a threaded cylindrical extension 66 which is receivable in lower end 70 of vertical support pole 12. Height adjustment member 64 is also shown including a nut 68 engaged with and selectively positioned along threaded cylindrical extension 66. In use, threaded cylindrical extension 66 is inserted into lower end 70 of vertical support pole 12 (and may be threadedly received therein) until nut 68 abuts the lower end 70. This may permit the height of foot member 58, from lower end 70 to lower surface 62 to be selectively adjusted by positioning nut 68 at alternate locations along threaded cylindrical extension 66.

Alternative height adjustment members 64 may be used. For example, the hollow interior of vertical support pole 12 from lower end 70 may be threaded and mates with threaded cylindrical extension 66. In this case, threaded cylindrical extension 66 can be rotated to extend a selective distance into vertical support pole 12 from lower end 70 and a nut 68 may not be provided. Alternately, extension may be slidingly received in lower end 70 and secured in position by, e.g., a set screw. In some embodiments, foot member 58 may not include a height adjustment member 64. In some examples, foot member 58 may be permanently or temporarily fastened to lower end 70 of vertical support pole 12 and extends a fixed height beneath lower end 70. FIG. 3 shows an example of a cantilevered support system 34 which does not include a foot member.

As exemplified in FIGS. 1 and 2, vertical support pole 12 has a smooth external surface. This may permit vertical support pole 12 to be easily cleaned, which may be desirable in, e.g. a hospital, nursing home or the like. Referring now to FIGS. 4 and 5 and 8 and 9, in some embodiments of cantilevered support system 10, one or more gripping members 72 may be provided on some or all of the outer surface of vertical support pole 12. Gripping members 72 may be of any design known in the art and may be of the design disclosed in U.S. patent application Ser. Nos. 13/677,743 and/or 13/677,652, the disclosure of each of which is incorporated herein by reference. As exemplified, gripping member 72 is formed as a sleeve which overlies, and is preferably secured to, vertical support pole 12. In some embodiments, gripping member 72 is permanently or temporarily coupled to vertical support pole 12 by, e.g. one or more of adhesive, hook-and-loop fasteners, nails, screws and bolts.

Gripping member 72 is adapted to enhance a user's grip on vertical support pole 12 and thereby reduce the grip strength required to use vertical support 12 (e.g. to stand from a bed, couch, or chair). Gripping member 72 may be made of one or more of metal, plastic or a resilient material such as neoprene or foam. As exemplified, gripping member 72 has an exterior surfaced formed by a plurality of protrusions. In some embodiments (not shown), gripping member 72 may have a smooth surface without protrusions and may be made from a material having a high coefficient of friction (e.g. rubber or foam).

Figure 5:
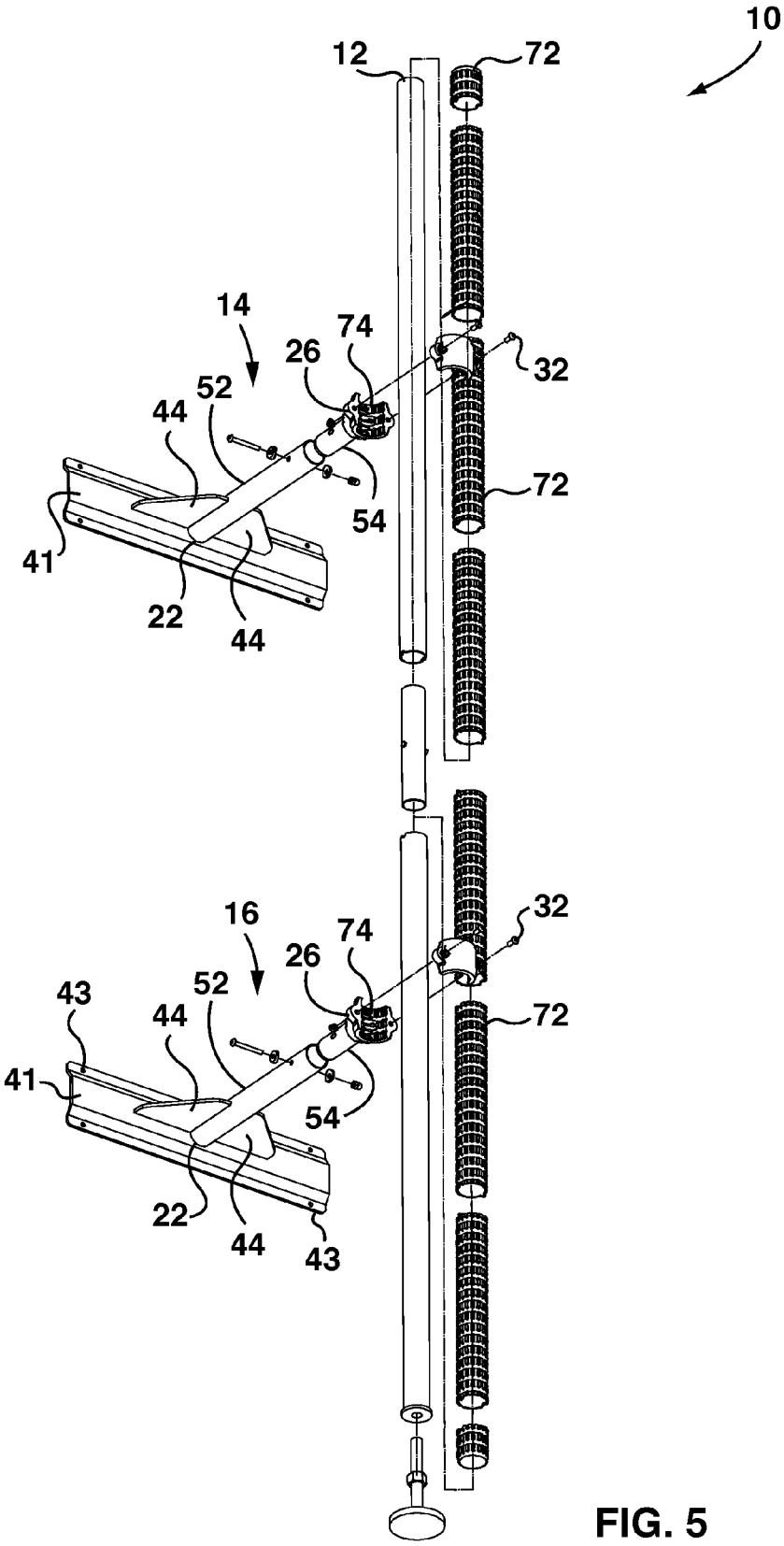
FIG. 5 is a perspective exploded view of the cantilevered support system of FIG. 4.

In some embodiments, clamping member 26 may have an inner engagement surface 74 having an configured to matingly engage with the external surface of gripping member 72 (see FIG. 5). If gripping member 72 is non-moveably secured to pole 12, then clamping member 26 may interlock with the external surface of gripping member 72 and thereby inhibit the rotation of vertical support pole 12 about its longitudinal axis 76 (see FIG. 4). In turn this may enhance the stability of vertical support pole 12 for a user grasping vertical support pole 12 to, e.g. stand from a bed, couch or chair.

Cantilevered support system 10 may be adapted to support, e.g., medical equipment. As exemplified in FIG. 1, an intra-venous (IV) bag holder 78 is provided on upper end 80 of vertical support pole 12. In some embodiments (not shown), vertical support pole 12 may include one or more other mounting members, such as hooks (e.g. for clothing), pegs, cables, rings, and bars, in addition to or instead of IV bag holder 78.

In accordance with another embodiment, longitudinally extending support arm assembly 14, 16 may be positionable at two or more locations on wall mount member 38, 40 and may be moveably, e.g., slidably, mounted thereto. For example, FIGS. 6 and 7 exemplify an embodiment of cantilevered support system 10 using wall mount system 82 (which substitutes wall mount system 18 shown in FIGS. 1 and 2) comprising upper and lower wall mount members 82*a*, 82*b*.

As exemplified, upper wall mount member 82*a* comprises an upper plate 84 that is slidably mounted to upper elongate member 88, and lower wall mount member 82*b* comprises lower plate 86 that is slideably mounted to lower elongate member 90. Accordingly, each longitudinally extending support arm assembly 14, 16 may be selectively positionable along elongate member 88, 90. In turn, this may permit vertical support pole 12 to be horizontally moveable to, e.g. either side of a bed 92 (see FIGS. 10 and 11).

Figure 6:
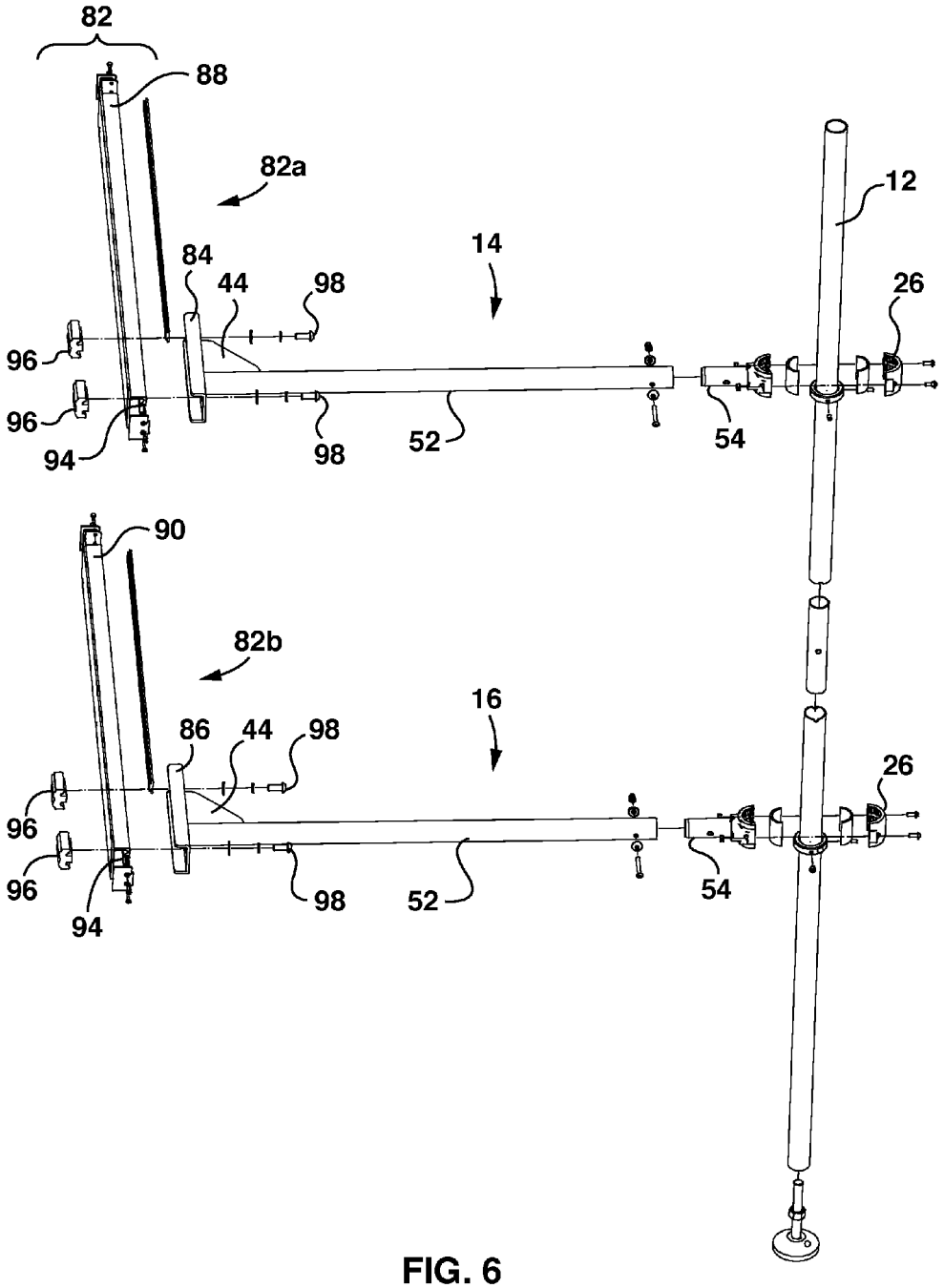
FIG. 6 is a perspective exploded view of a cantilevered support system according to a further embodiment.
Figure 7:
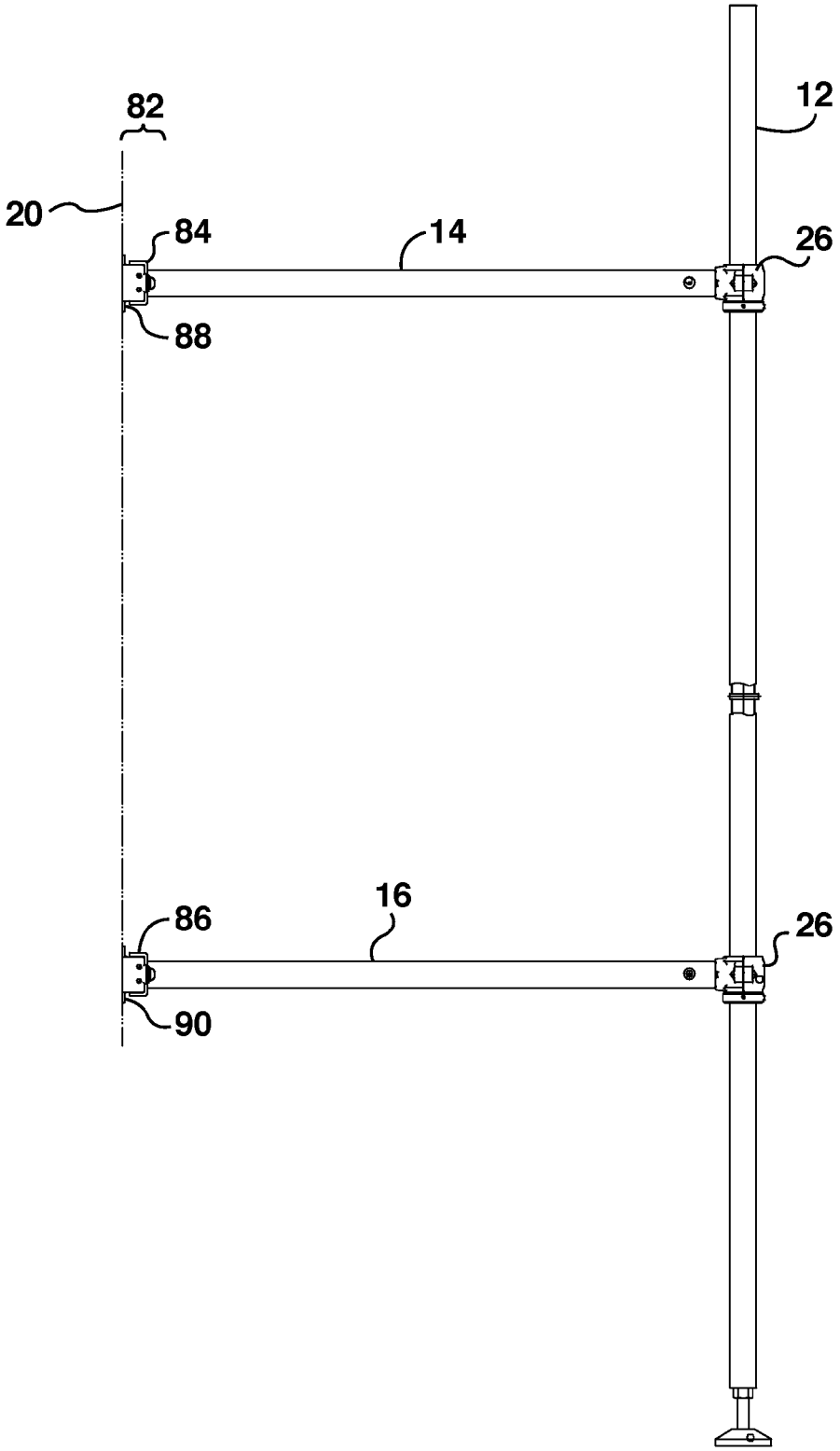
FIG. 7 is a side elevation view of the cantilevered support system of FIG. 6.
Figure 8:
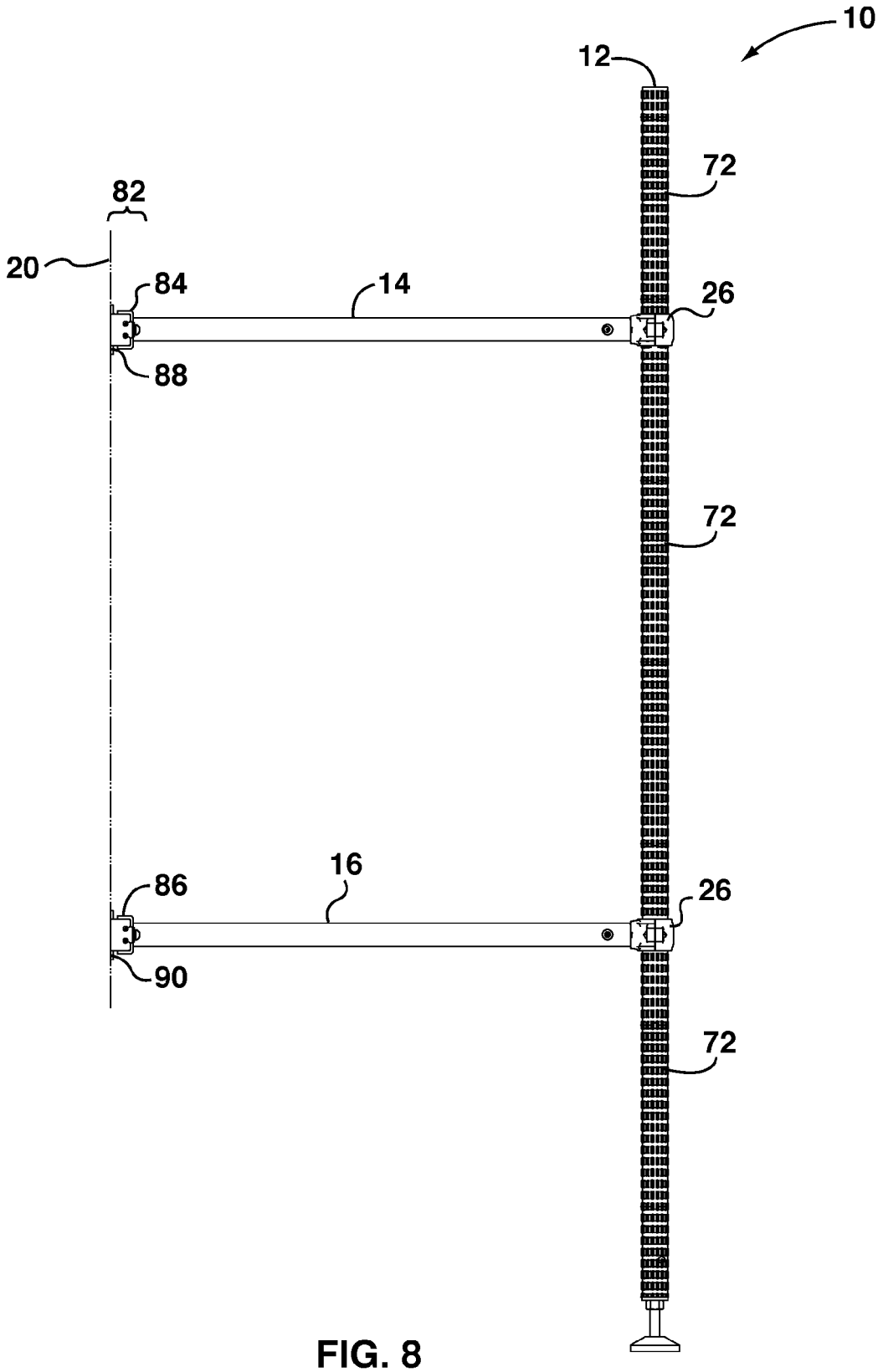
FIG. 8 is a side elevation view of the cantilevered support system of FIG. 6 including gripping members.
Figure 9:
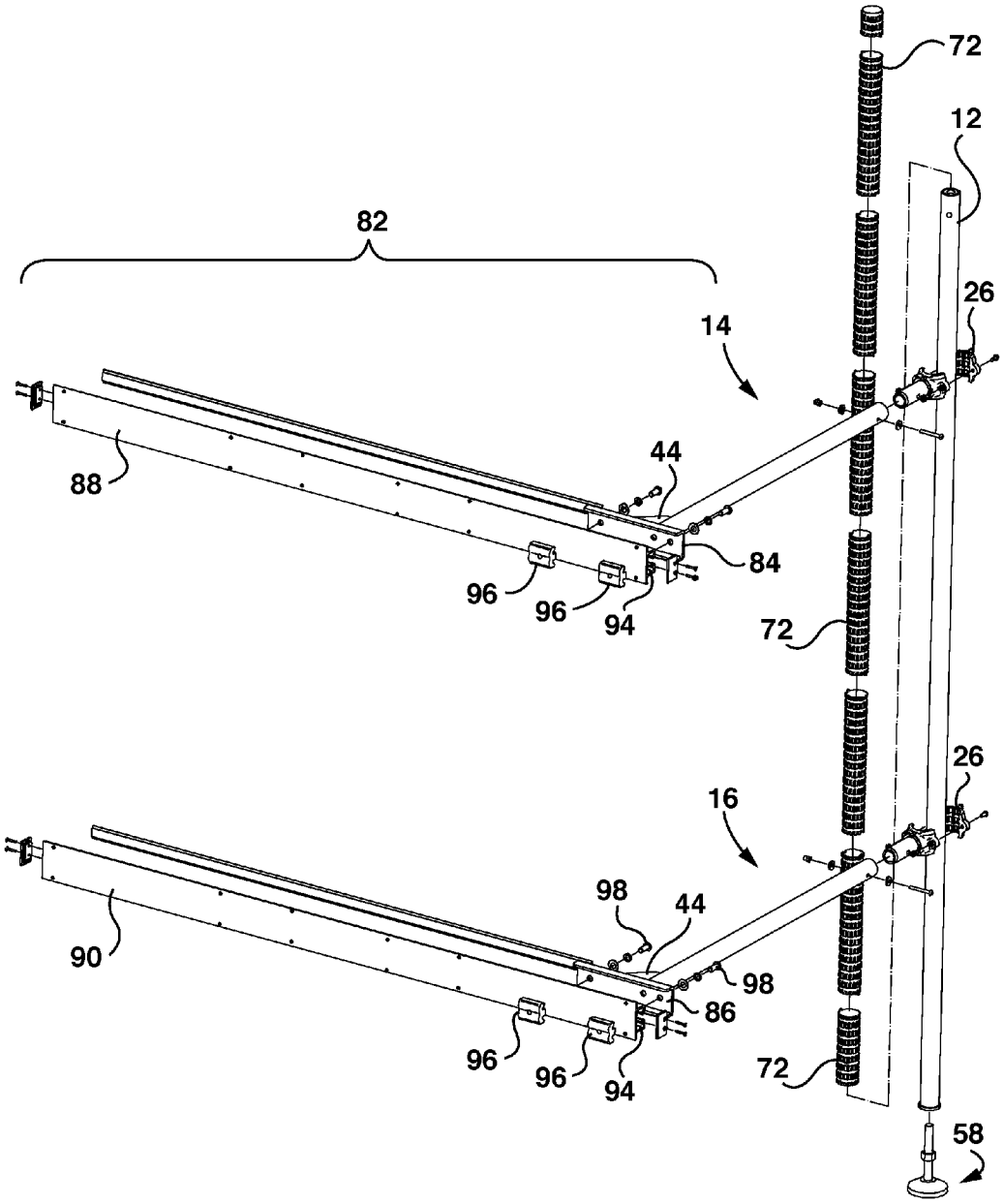
FIG. 9 is a rear perspective exploded view of the cantilevered support system of FIG. 6 including gripping members.

As best seen in FIG. 6, each elongate member 88, 90 has a guide track 94 extending along its length. As shown, each plate 84, 86 includes a pair of guides 96 secured in a recess of plate 84, 86 by fasteners 98 (e.g., screws that are threadedly received in guides 96). Guides 96 are shown sized to travel inside and along the guide track 94 of elongate member 88, 90. Accordingly, plate 84, 86 may slide along a path defined by the guide track 94 of elongate member 88, 90.

It will be appreciated wall mount system 82 may have any suitable structure that may be mounted to a wall 20, and permit longitudinally extending support assemblies 14 and 16 to move along a path defined by the wall mount system 82. For example, the slides may comprise rollers (small wheels) sized to roll along and inside the guide track of elongate member 88, 90. In an alternate embodiment, arms 14, 16 may be removed from elongate member 88, 90 and moved to another portion of elongate member 88, 90 and secured to that portion of elongate member 88, 90 so as to be mounted in an alternate location. In a further alternate embodiment, a plurality of wall mount members may be provided (e.g., two upper wall mount members and two lower wall mount members). The upper wall mount members may be secured to wall 20 at opposite sides of a bed and, similarly, the lower wall mount members may be secured to wall 20 at opposite sides of the bed. Arms 14, 16 may be selectively securable to the upper and lower wall mount members so as to be moved from one side of the bed to another.

Figure 10:
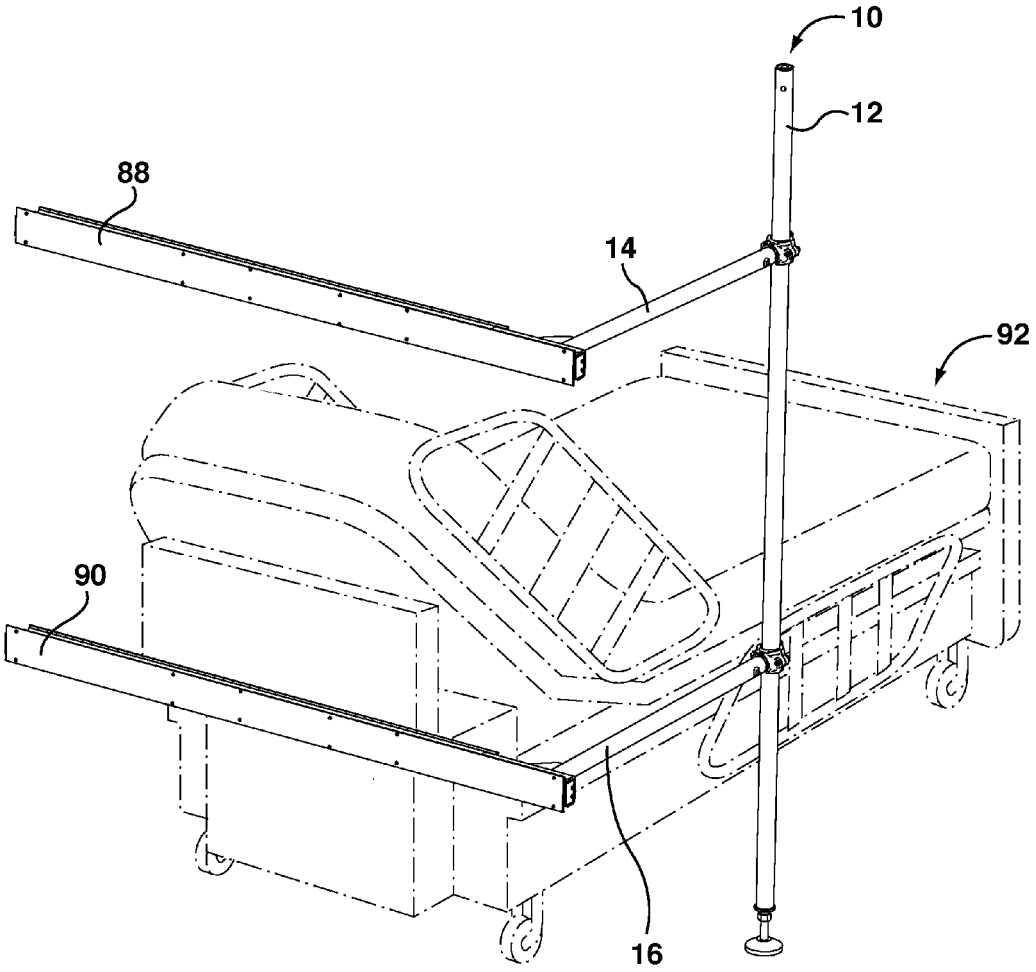
FIGS. 10 and 11 show the cantilevered support system of FIG. 6 with longitudinally extending support arm assemblies at alternate positions; and, FIG. 12 shows a flowchart illustrating a method of providing support for a person.
Figure 11:
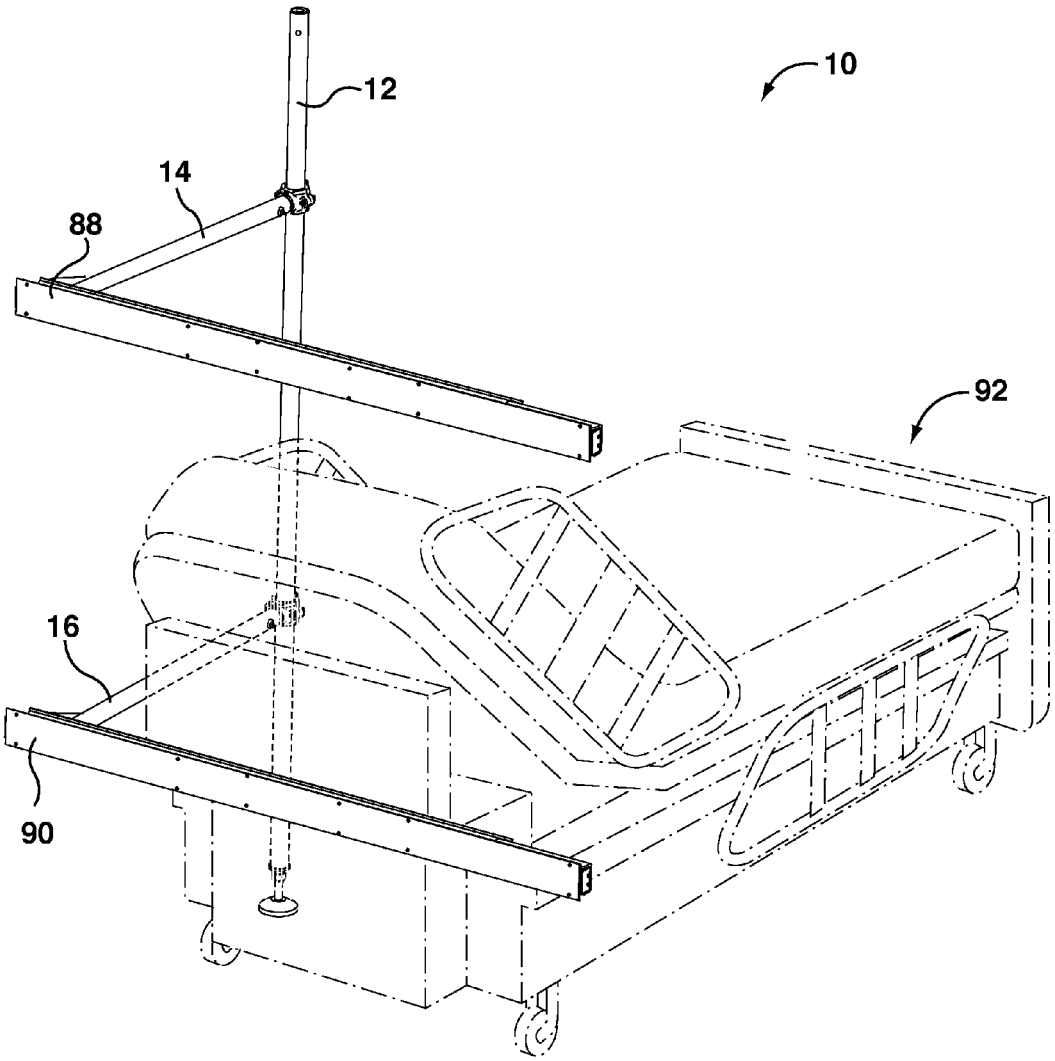

For example, in FIG. 10, longitudinally extending support arm assemblies 14, 16 are positioned on one side of bed 92 and, in FIG. 11, longitudinally extending support arm assemblies 14, 16 have been slid to the other side of bed 92. As exemplified, elongate members 88 and 90 are mounted to wall 20 at the position of a head of bed 92. In use, a user may slide wall mount members 84, 86 (obscured from view) to a selected position along elongate members 88, 90. Depending upon the height or the elongate members 88, 90, bed 92 may be moved away from the wall to permit the repositioning of the arms 14, 16.

In any embodiment, one of the longitudinally extending support arm assemblies 14, 16 may be positioned at a height suitable for use as a hand rail so as to assist a person to stand or walk. For example, one of the longitudinally extending support arm assemblies 14, 16 may be positioned at about waist height and may function as a bedrail.

In some embodiments (not shown), wall mount system 82 may include one or more locking members that lock wall mount members 84, 86 in position after they have been selectively positioned along elongate member 88, 90. In some examples, the locking member can be disengaged to permit wall mount members 84, 86 to be repositioned along elongate members 88, 90. For example, a set screw or the like may be used. An advantage of this design is that the support pole 12 may be moved the side of bed 92 which may be required by a user or to hold medical equipment. If a foot member 58 which is height adjustable is provided, then foot member 58 may be adjusted such that lower surface 62 is positioned above floor 60 before the arms are slid to their new position. In the new position, the foot member may be adjusted such that lower surface 62 engages floor 60.

Figure 12:
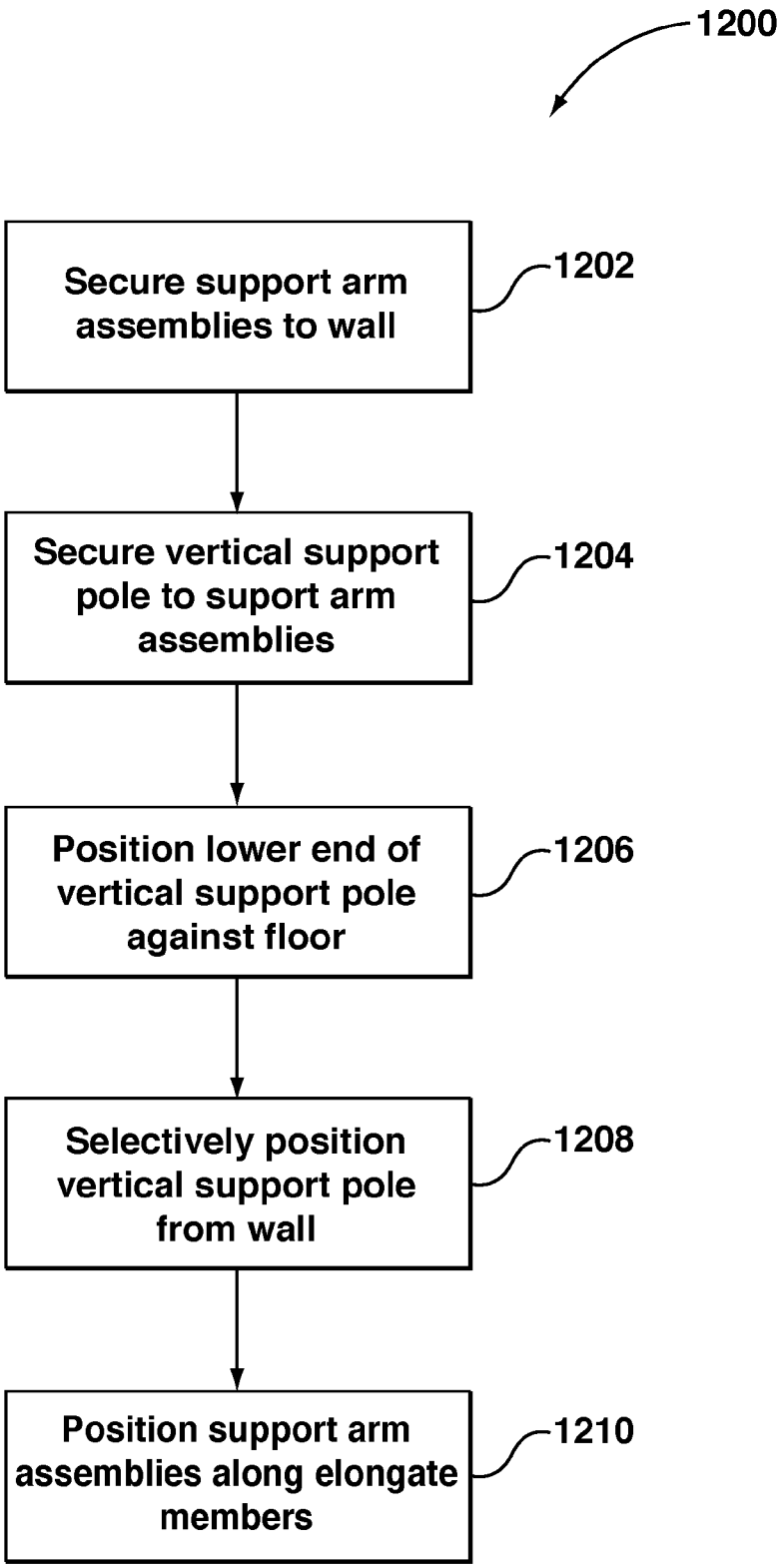

Reference is now made to FIG. 12 which shows a flowchart illustrating a method 1200 of providing support for a person, in accordance with at least one embodiment. Although the flowchart illustrates method 1200 as a series of steps performed in a particular order, in alternative embodiments some of the steps may be performed in a different order and/or some of the steps may be performed simultaneously. Further, in some alternative embodiments of method 1200, some of the steps described below may be omitted, and/or some steps not described below are added.

For clarity, method 1200 is described with reference to certain embodiments of a cantilevered support system. In alternative embodiments, method 1200 is practiced using different apparatus or different embodiments of a cantilevered support system.

At 1202, longitudinally extending support arm assemblies 14, 16 are secured to wall 20. In some embodiments, longitudinally extending support arm assemblies 14, 16 are coupled to a wall mount system 18 or 82. In at least some of these embodiments, securing longitudinally extending support arm assemblies 14, 16 to wall 20 includes securing wall mount system 18 or 82 to wall 20 (e.g. by fasteners 42).

In some examples, wall mount system 18 or 82 includes wall mount and/or elongate members 38 and 40 or 88 and 90. In at least some such examples, longitudinally extending support arm assemblies 14, 16 are securable to the wall mount and/or elongate members 38 and 40 or 88 and 90 and securing longitudinally extending support arm assemblies 14, 16 to wall 20 includes securing wall mount or elongate members 38 and 40 or 88 and 90 to wall 20. In some embodiments, wall mount or elongate members 38 and 40 or 88 and 90 are secured to wall 20 at a location where the head of bed 92 will be positioned or on a wall behind a toilet or a seating member such as a chair, couch or the like. This may permit, in embodiments of cantilevered support system 10 which includes a wall mount system 82 that permits the longitudinally extending support arm assemblies 14, 16 to move horizontally, selective positioning of the longitudinally extending support arm assemblies 14, 16 at either side of bed 92 or a toilet.

In some examples, wall mount system 18 or 82 is positioned such that stabilizers 44 extend generally horizontally. This may permit stabilizers 44 to provide lateral stability to horizontal components of force applied to vertical support pole 12 when, e.g. a user grasps vertical support pole 12 and pulls toward themself to stand up.

At 1204, vertical support pole is secured to longitudinally extending support arm assemblies 14, 16. In some embodiments, this includes opening clamping members 26 to receive vertical support pole 12, then closing clamping members 26 (e.g. by inserting and tightening fasteners 32) around vertical support pole 12 to secure vertical support pole 12 to longitudinally extending support arm assemblies 14 and 16.

At 1206, the lower end of vertical support pole 12 is positioned against the floor 60. This may permit vertical components of force applied to vertical support pole 12 to be transferred to floor 60, and thereby improve the weight bearing capacity and stability of vertical support pole 12. In some embodiments, lower end 70 of vertical support pole 12 is positioned directly against floor 60. In alternative embodiments, vertical support pole 12 includes a foot member 58. In these embodiments, the lower end of vertical support pole 12 is the lower surface 62 of foot member 58. In some examples, positioning lower surface 62 against floor 60 includes moving vertical support pole 12 downwardly until lower surface 62 contacts floor 60. This may be performed before, during or after vertical support pole 12 is secured to longitudinally extending support arm assemblies 14 and 16 at 1204.

In some embodiments, foot member 58 includes a height adjustment member 64. In some examples, positioning lower surface 62 against floor 60 includes adjusting the longitudinal height of height adjustment member 64 so that lower surface 62 makes contact with floor 60.

At 1208, vertical support pole 12 is selectively positioned at a distance from wall 20. This may permit vertical support pole 12 to be aligned in front of a user who is on, e.g. a bed, couch, chair or toilet. In some embodiments, the length of longitudinally extending support arm assemblies 14, 16 is selectively adjustable. In some examples, vertical support pole 12 is selectively positioned at a distance from wall 20 by selectively adjusting the length of longitudinally extending support arm assemblies 14, 16 (e.g., by telescoping them, by using more than two arm members 52, 54 and/or by selecting arm members 52 and/or 54 of a desired length).

At 1210, longitudinally extending support arm assemblies 14, 16 are selectively positioned along elongate wall members 88, 90. This may permit longitudinally extending support arm assemblies 14, 16 (and therefore vertical support pole 12) to be selectively positioned along wall 20 to, e.g. either side of bed 92 or a toilet. In some embodiments, elongate wall members 88, 90 define guide tracks 94 to which longitudinally extending support arm assemblies 14, 16 are mounted and along which longitudinally extending support arm assemblies 14, 16 slide along. In some examples (not shown), wall mount system 82 includes a locking member which is disengaged prior to moving longitudinally extending support arm assemblies 14 and 16 along elongate wall members 88 and 90.

While the above description provides examples of the embodiments, it will be appreciated that some features and/or functions of the described embodiments are susceptible to modification without departing from the principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A cantilevered support system comprising:

(a) a vertical support pole having an upper end and a lower end, wherein the vertical support pole has an adjustable length;

(b) a wall mount system which comprises at least an upper elongate member and a lower elongate member, each elongate member having a guide track;

(c) an upper support arm assembly extending perpendicular from the upper elongate member and comprising an inner end having an upper plate and an outer end securable to the vertical support pole, the upper plate having a guide slidably positioned in the guide track of the upper elongate member and the upper plate is removably securable to the guide positioned in the guide track of the upper elongate member;

(d) a lower support arm assembly extending perpendicular from the lower elongate member and comprising an inner end having a lower plate and an outer end securable to the vertical support pole, the lower plate having a guide slidably positioned in the guide track of the lower elongate member and the lower plate is removably securable to the guide positioned in the guide track of the lower elongate member, wherein each upper and lower support arm assembly is positionable at alternate positions along the corresponding upper and lower elongate members.

2. The cantilevered support system of claim 1 wherein the adjustable length of the vertical support pole is provided by a height adjustable foot member provided on the lower end of the vertical support pole.

3. The cantilevered support system of claim 1 wherein the outer end of each support arm assembly comprises an openable clamping member comprising inner and outer casings which, when assembled, surround a circumference of the vertical support pole whereby the vertical support pole is releasably securable to the openable clamping member.

4. The cantilevered support system of claim 3 wherein each support arm assembly is longitudinally adjustable whereby the openable clamping member is positionable at varying distances from the wall.

5. The cantilevered support system of claim 3 wherein each of the casings has an inner recess which bears on the vertical support pole when the openable clamping member is in a closed configuration surrounding the circumference of the vertical support pole.

6. The cantilevered support system of claim 5 wherein a grip member is provided between the vertical support pole and the casings.

7. The cantilevered support system of claim 5 wherein the vertical support pole is provided with a gripping member having an external surface and the openable clamping member has an inner engagement surface that is configured to matingly engage with the external surface of the gripping member.

8. The cantilevered support system of claim 7 wherein the gripping member comprises a plurality of protrusions.

9. The cantilevered support system of claim 1 wherein each support arm assembly is provided with a wall mount member and a horizontally extending stabilizer extends between the wall mount member and an inner end of each support arm assembly.

* * * * *